US008656792B2

(12) United States Patent
Kirste et al.

(10) Patent No.: US 8,656,792 B2
(45) Date of Patent: Feb. 25, 2014

(54) PIPETTE DEVICE HAVING A THROTTLE POINT IN THE PIPETTE DUCT

(75) Inventors: Vinzenz Kirste, Bonaduz (CH); Helmut Knapp, Ebikon (CH); Urs Lendenmann, Chur (CH); Noa Schmid, Kriens (CH); Tobias Seiler, Films Dorf (CH); Fabian Winter, Trin (CH)

(73) Assignee: Hamilton Bonaduz AG, Bonaduz (CH)

( * ) Notice: Subject to any disclaimer, the term of this patent is extended or adjusted under 35 U.S.C. 154(b) by 181 days.

(21) Appl. No.: 13/190,686

(22) Filed: Jul. 26, 2011

(65) Prior Publication Data

US 2012/0017704 A1 Jan. 26, 2012

(30) Foreign Application Priority Data

Jul. 26, 2010 (DE) ..... 10 2010 038 414
Jul. 6, 2011 (EP) ..... 11172869

(51) Int. Cl.
*B01L 3/00* (2006.01)

(52) U.S. Cl.
USPC ..... 73/864.16; 73/864.13; 422/501; 422/516

(58) Field of Classification Search
USPC ..... 73/864.13, 864.15, 864.16
See application file for complete search history.

(56) References Cited

U.S. PATENT DOCUMENTS 2,523,809 A * 9/1950 Bronk et al. ..... 604/249
3,290,946 A * 12/1966 Pursell ..... 73/864.15
4,335,621 A * 6/1982 Tervamaki et al. ..... 73/863.32
5,355,738 A * 10/1994 Heinonen ..... 73/864.13
5,895,838 A * 4/1999 Harjunmaa et al. ..... 73/864.13
2006/0137479 A1 * 6/2006 Gilbert ..... 73/864.16
2010/0322822 A1 * 12/2010 Fritchie et al. ..... 422/63
2011/0301538 A1 * 12/2011 Stammen et al. ..... 604/121
2011/0318242 A1 * 12/2011 Nay ..... 422/501

FOREIGN PATENT DOCUMENTS

DE 100 49 507 A1 4/2002
DE 101 18 875 C1 9/2002
GB 1 395 424 5/1975
GB 1 470 515 4/1977
WO 97/02893 A1 1/1997
WO 01/88549 A1 11/2001
WO 2009/067834 A2 6/2009
WO WO 2010057473 A2 * 5/2010 ..... A61M 5/145

* cited by examiner

*Primary Examiner* — Peter Macchiarolo
*Assistant Examiner* — Natalie Huls
(74) *Attorney, Agent, or Firm* — Rothwell, Figg, Ernst & Manbeck, PC

(57) ABSTRACT

A pipette device including a metering liquid receptacle designed to be filled, at least in part, with working fluid and which has a pipette opening as a first tapering of cross-section of flow, a pressure change device which is designed to change the pressure of the working fluid in the metering liquid receptacle, and a throttle point in a pipette duct designed to be filled with working fluid as a further tapering of cross-section of flow. The throttle point is arranged fluid-mechanically between the metering liquid receptacle and the pressure change device and is dimensioned in such a way that a ratio of a flow resistance of the pipette opening for dispensed metering liquid to a flow resistance of the throttle point for working fluid, which flows through the throttle point when the metering fluid is dispensed, is less than 0.5.

16 Claims, 1 Drawing Sheet

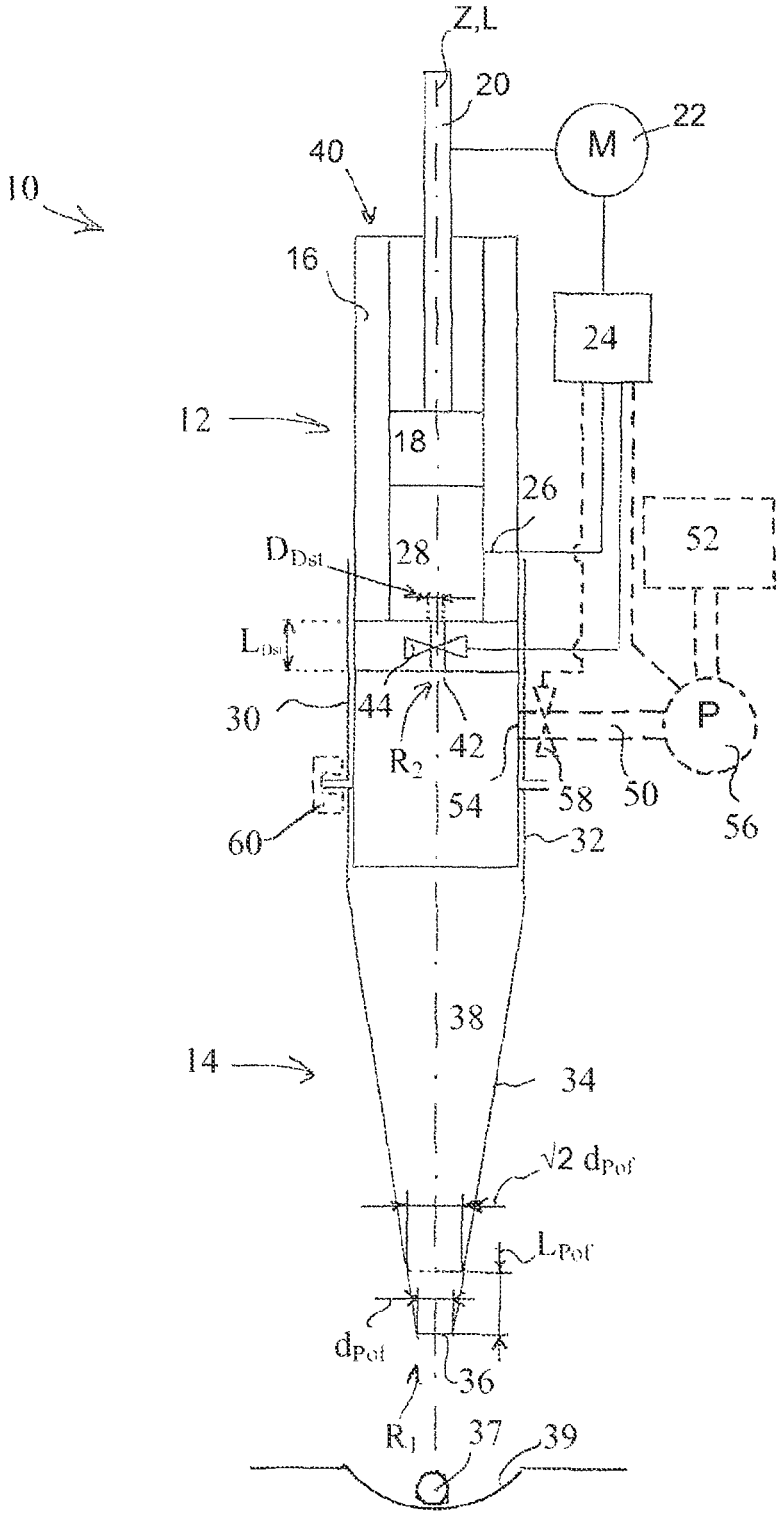
Z,L
20
22
M
40
10
16
24
12
18
26
52
28
$D_{Dst}$
$L_{Dst}$
30
44
42
P
$R_2$
54
58
50
56
60
32
38
14
34
$\sqrt{2}\ d_{Pof}$
$L_{Pof}$
$d_{Pof}$
36
$R_1$
37
39

PIPETTE DEVICE HAVING A THROTTLE POINT IN THE PIPETTE DUCT

BACKGROUND OF THE INVENTION

1. Field of the Invention

The present invention relates to a pipette device, at least for dispensing metering liquid by increasing the pressure of a working fluid.

2. Description of Related Art

Pipette devices comprising a metering liquid receptacle which is filled, at least in part, with working fluid and has a pipette opening as a first tapering of cross-section of flow, through which metering liquid can be dispensed from the metering liquid receptacle as a function of the pressure of the working fluid, and comprising a pressure change device which is designed to change the pressure of the working fluid in the metering liquid receptacle are well known from the prior art.

BRIEF SUMMARY

When dispensing metering liquid, a metering liquid provided in a metering liquid receptacle is discharged, in a manner known per se, through a pipette opening in the metering liquid receptacle by increasing a pressure of a working fluid which is likewise located in the metering liquid receptacle.

Since the pipette opening generally constitutes a narrowest cross-section of flow when expelling the metering liquid from the metering liquid receptacle, the pipette opening forms a first tapering of the cross-section of flow of the pipette device discussed herein.

Pipette devices of the aforementioned type are used, for example, as wash heads, wherein the metering liquid receptacle is filled, either fully or in part, with metering liquid by a metering liquid supply which liquid is then expelled from said receptacle as a result of the described dispensing method by means of overpressure of the working liquid based on the ambient pressure of the liquid receptacle.

With these wash heads the metering liquid is a washing liquid which is supplied through the pipette opening so as to dean an object provided therebelow, for example a container, using the washing liquid. In this case, too, the process depends on a correct proportioning of the expelled amount of washing liquid.

However, in principle it is also not to be ruled out that wash heads receive the metering liquid, i.e. for example washing liquid, through the pipette opening and into the metering liquid receptacle, either additionally or alternatively to the previously mentioned supply by aspiration, which is known per se, i.e. by means of a negative pressure of the working fluid in the metering liquid receptacle.

A drawback of the aforementioned pipette device, in particular in terms of its design as a wash head, lies in that deposits form, owing to the repeated expulsion of metering liquid through the pipette opening, either at the pipette opening or in a duct which leads to the pipette opening and these deposits change the cross-section of flow of the pipette opening and of the duct leading to the pipette opening, respectively. This changes the metering behaviour in such a way that after some operating time, pipette devices which are basically identical in terms of structure and are operated with the same metering liquid and otherwise identical operating parameters may display undesirable, different metering behaviour.

The object of the present invention is therefore to develop a pipette device of the aforementioned type in such a way that its metering behaviour is rendered less sensitive to changes in the cross-section of flow of the pipette opening and of the duct leading to the pipette opening in the metering liquid receptacle, such that possible or even probable deposits at the pipette opening do not affect the metering behaviour of the pipette device, or at least affect it less than before.

This object is achieved, in accordance with the present invention, by a generic pipette device wherein the pipette device comprises, as a further tapering of the cross-section of flow, a throttle point in a pipette duct filled with working fluid during normal operation, said throttle point being arranged fluid-mechanically between the metering liquid receptacle and the pressure change device and being dimensioned in such a way that a ratio of a flow resistance ($R_1$) of the pipette opening for dispensed metering liquid to a flow resistance ($R_2$) of the throttle point for working fluid, which flows through the throttle point when the metering fluid is dispensed, is less than 0.5, preferably less than 0.3, most preferably less than 0.225, the flow resistances of the respective tapering of cross-section of flow being calculated under consideration of the product of the viscosity of the medium of working fluid and dosing liquid associated with the respective tapering of cross-section of flow and the characteristic length of the associated tapering of cross-section of flow, divided by the fourth power of the characteristic dimension of the cross-section of flow of the associated tapering of cross-section of flow.

By means of the throttle point described, a narrow point in the cross-section of flow is formed between the pressure change device and the metering liquid receptacle and ensures that a change in pressure in the working fluid caused by the pressure change device is not continued abruptly, but merely gradually in the metering liquid receptacle, which surprisingly renders the dispensing behaviour of the pipette device insensitive to changes, in particular changes caused by storage, to the cross-section of flow of the pipette opening. Pipette devices which are basically identical in terms of structure and are operated substantially with identical set-ups may thus display a substantially identical dispensing behaviour although differing amounts of deposits are located at their pipette openings.

The ratio of the aforementioned flow resistances, which is decisive for the functioning of the solution presented here, results in the throttle point which is flown through by working fluid, generally a gas, having a considerably smaller cross-sectional opening than the pipette opening. However, it is not to be ruled out that a liquid is also used as a working fluid.

The respective dynamic viscosity is used as viscosity and is generally denoted in the literature by the symbol "$\eta$".

The referenced characteristic length of the associated tapering of cross-section may be the length of the cylindrical duct in the case of cylindrical taperings of cross-section of flow, or, in the case of ducts tapering conically towards the tapering of the cross-section of flow, may be the length of the duct portion in which the area of cross-section of flow of the duct doubles starting from the smallest area of cross-section of flow in the throttle point or in the pipette opening. If there is no doubling of the area of cross-section of flow over the maximum determinable length of the duct, the entire length of the duct can be used as the characteristic length.

In the case of circular cross-sections of flow the diameter can be used as a characteristic dimension of the cross-section of flow, an edge length in the case of square cross-sections of flow, an arithmetic mean of long and short edge lengths in the case of rectangular cross-sections of flow, and an arithmetic mean of long and short axes in the case of elliptical cross-sections of flow, etc. If the cross-section of flow changes over the length of the tapering of cross-section of flow, the smallest cross-section of flow occurring in the tapering of cross-section of flow should be used.

The use of characteristic dimensions is well known in the field of fluid mechanics.

The ratio of the flow resistance ($R_1$) of the pipette opening and the flow resistance ($R_2$) of the throttle point is preferably calculated as follows:

$$\frac{R_1}{R_2} = \frac{\eta_{Pof} \cdot l_{Pof} \cdot d_{Dst}^4}{\eta_{Dst} \cdot l_{Dst} \cdot d_{Pof}^4}$$

where $\eta_{Pof}$ is the dynamic viscosity of a metering liquid flowing through the pipette opening, $\eta_{Dst}$ is a dynamic viscosity of a working fluid flowing through the throttle point, $l_{Pof}$ is a characteristic length of the pipette opening, $l_{Dst}$ is a characteristic length of the throttle point, $d_{Pof}$ is a characteristic dimension of the cross-section of flow of the pipette opening and $d_{Dst}$ is a characteristic dimension of the cross-section of flow of the throttle point.

The present invention preferably relates to a wash-head pipette device, as mentioned at the outset, which is designed to dispense washing liquid in precise doses as a metering liquid. Such wash-head pipette devices are generally used to clean objects received in sample containers, for example so-called "wells", by dispensing a precisely metered amount of washing liquid. In this instance the precise metering of the washing liquid is of utmost importance in order to produce a predetermined cleaning state. The volume flow of washing liquid is generally set in such a way that the washing power is maximal, yet the washing process is as quick as possible. If washing liquid is dispensed incorrectly from the pipette, there may be a risk of "overwashing", which could lead to elements being dissolved on the object to be washed and/or in the sample container, which is undesirable.

Although it is not to be ruled out that such a wash-head pipette device aspirates the washing liquid as metering liquid into the metering liquid receptacle via the pipette opening, for reasons of simpler handling washing liquid is fed to the metering liquid receptacle of a preferred wash-head pipette device as metering liquid through a metering liquid inlet.

The wash-head pipette device discussed here may therefore comprise a metering liquid inlet, via which the metering liquid receptacle can be filled, at least in part, with metering liquid, i.e. in the present application with washing liquid. For this purpose the metering liquid inlet may discharge into the metering liquid receptacle. The metering liquid inlet is generally provided (apart from the advantageous discharge of the metering liquid inlet just described) as a duct formed separately from the metering liquid receptacle.

In order to operate the metering liquid inlet, in a further advantageous embodiment of the present invention the wash-head pipette device may comprise a metering liquid pump, with which metering liquid, in particular washing liquid as metering liquid, can be conveyed along the metering liquid inlet into the metering liquid receptacle. Furthermore, in order to prevent an undesired supply of residual metering liquid from the metering liquid inlet into the metering liquid receptacle, a valve may be provided at the metering liquid inlet, in particular in an area dose to the discharge of the metering liquid inlet, and can be opened and closed by a control means. Incidentally, the metering liquid pump can also be operated by this or another control means.

However, the above-mentioned metering liquid pump does not have to be provided since the metering liquid, in particular as a washing liquid, can be conveyed into the metering liquid receptacle by gravity from a reservoir located geodetically above the discharge of the metering liquid inlet. In this case, however, the above-mentioned valve is absolutely necessary.

In order to increase the washing efficiency of a wash-head pipette device, it may comprise a plurality of pipette ducts which are provided substantially mutually parallel, in such a way that a plurality of objects corresponding to the plurality of pipette ducts can simultaneously be subjected to cleaning by the wash-head pipette device.

Even in the case of a multi-duct pipette device, the present invention is of great advantage since the invention can ensure that each pipette duct can dispense substantially the same amount of metering liquid with a high level of accuracy, even though the individual pipette ducts, whether as a result of manufacturing tolerances of coupled pipette tips, whether as a result of different amounts of deposits at the pipette openings, or whether as a result of a combination of these or other causes, may be of different geometrical shapes in such a way that the individual pipette ducts of a multi-duct pipette head would provide different pipetting results with identical operating parameters of the pipette device without application of the present invention.

The principle of the throttling of the working fluid flow between the metering liquid receptacle and the pressure change device can be successfully applied not only to the dispensing of metering liquids, but also to the aspiration thereof. In this case, too, the metering behaviour can be made insensitive to deposits and other changes to the cross-section of flow in the pipette opening.

The present invention therefore also relates, in particular, to such pipette devices which are also designed, in addition to the above-mentioned dispensing, for the aspiration of metering liquid, in this case by reducing the pressure of the working fluid in the metering liquid receptacle. In this case, with aspiration of metering liquid it can be aspirated into the metering liquid receptacle through the pipette opening as a function of the pressure of the working fluid.

In the case of metering processes, i.e. the aspiration and dispensing of metering liquid, it is possible to determine differences, in the case of such pipette devices in the prior art which are identical in terms of structure and are operated using substantially identical operating parameters, in the metering behaviour for different metering liquids, in particular for metering liquids of different viscosity.

It has been found that the throttle point in the pipette duct, which throttle point is recommended in this instance and is arranged fluid-mechanically between the pressure change device and the metering liquid receptacle, is also adapted, within specific limits, to homogenise the metering behaviour with regard to metering liquids of different viscosity. In other words, in the case of pipette devices which are basically identical in terms of structure and have substantially identical operating parameters, the metering behaviour of these pipette devices is independent, within specific limits, of the viscosity of the metering liquid.

However, compared to the previous case of a metering behaviour substantially independent of changes to the cross-section of flow of the pipette opening, it is thus necessary to considerably reduce the cross-section of flow of the throttle point.

Tests have shown that the metering behaviour of substantially identical pipette devices with substantially identical operating parameters is substantially independent of the viscosity of the metering liquid if the ratio of the flow resistance ($R_1$) of the pipette opening for dispensed metering liquid to the flow resistance ($R_2$) of the throttle point is less than 0.001, preferably less than 0.00075, most preferably less than 0.0005 in the case of working fluid flowing therethrough during dispensing of the metering fluid.

The independence of the metering behaviour from viscosity in turn applies both to the dispensing and aspiration behaviour. Merely the dispensing is used as a reference process.

Tests have shown that the above-mentioned upper limits of the ratio of the flow resistances result in a metering behaviour which is substantially independent of the viscosity of the metering liquid if the dynamic viscosity of the metering liquid does not exceed the value of 0.004 $Nsm^{-2}$, preferably 0.0035 $Nsm^{-2}$, most preferably 0.0031 $Nsm^{-2}$.

Working fluids of which the dynamic viscosity does not exceed the value of 0.00003 $Nsm^{-2}$, preferably 0.00002 $Nsm^{-2}$, most preferably 0.0000175 $Nsm^{-2}$ can thus be used with success. Dynamic viscosity is again intended in this instance.

It can further be conceived to equip the throttle point with a cross-section of flow which can be selectively changed, for example by changing the gap width of an annular gap or by using a mechanism similar to that used to adjust the shutter in mechanical cameras. The cross-section of flow of the throttle point can thus be adapted to the respective working fluid used and/or to the respective metering liquid to be metered.

For improved control, in particular for fine control of an aspiration and/or dispensing process, it may also be conceived for the pipette duct to comprise a valve which is adjustable between a closed position, in which a working fluid flow in the pipette duct is prevented, and an open position, in which a working fluid flow in the pipette duct is enabled. The valve can first be held closed until the working fluid has been brought to a desired pressure in an area located at least in the vicinity of the pressure change device. In particular, the throttle point may be changeable up to a cross-section of zero, in such a way that the valve described here can be formed, using an advantageously low number of components, by the above-described throttle point comprising a changeable cross-section of flow.

Further, an amount of liquid can be metered in a highly precise manner, known per se, by intermittently opening and closing the valve.

Since, as was demonstrated at the outset, the effect of the invention discussed here lies in the fact that a pressure change initiated by the pressure change device cannot spread abruptly into the metering liquid receptacle, it is advantageous if the valve is also provided at the throttle point or fluid-mechanically between the pressure change device and the throttle point.

In accordance with a constructionally possible embodiment of the present invention, at least one reservoir of working fluid subjected to a system pressure may be provided as the pressure change device. More specifically, in order to carry out both aspiration and dispensing processes in the same pipette duct, a dispensing reservoir subjected to a first system pressure and an aspiration reservoir subjected to a second system pressure may be provided which are selectively connectable to the pipette duct in a pressure-transmitting manner and are separable therefrom, the first system pressure being greater than an ambient pressure of the pipette device and the second system pressure being lower than the ambient pressure.

In terms of the flow processes of the working fluid through the throttle point, it is advantageous in the case of the aspiration and dispensing processes if the system pressure does not exceed an overpressure of 1.5 bar, preferably 1.2 bar, most preferably 1.0 bar compared to the ambient pressure of the metering liquid receptacle, at least for dispensing processes. If there are greater pressure differences between the system pressure and the ambient pressure, this could result in excessively turbulent flows of the working fluid through the throttle point, which could impair the effect of the present invention under some circumstances.

However, in principle it may also be conceived for the pressure change device to comprise a pump operating discontinuously or continuously, optionally in cooperation with a valve arrangement which may be arranged in the conveying path of the pump and can be opened and closed selectively. With regard to an ever desired automation of metering processes, it is advantageous if the pump is driven by a motor.

In accordance with a further advantageous embodiment of the pipette device, it may also be conceived for the pressure change device to comprise a piston-cylinder device having a cylinder extending along a cylinder axis and having a piston received movably therein along the cylinder axis, the cylinder and piston defining at least one working volume which can be changed by a relative movement of the piston relative to the cylinder and which is in fluid communication with the pipette duct or can be brought into fluid communication therewith. The piston-cylinder arrangement is the most common design of the pressure change device in pipette devices. It also offers the option of providing a very precise pressure control owing to the use of small piston areas and comparatively long piston strokes.

Even with the aforementioned piston-cylinder device as the pressure change device, the pipette device may also be a pipette device which is intended to be manually operable, in particular the piston being movable relative to the cylinder by manual actuation. This actuation may be provided directly, i.e. by manually pulling out or pressing in the piston, or indirectly, for example by tensioning a spring which drives a relative movement between the piston and cylinder once released. The manually actuatable pipette device preferably comprises merely precisely one pipette duct to provide metering which is as accurate as possible.

"Intended to be manually actuatable" is not to be understood to mean cases which are actuated, in principle, by motor or in an otherwise automated manner and which can be operated further by a manual emergency actuation merely in the event of the failure of a power supply.

Even for cases of metering by aspiration and dispensing, in order to satisfy the highest demands placed on hygiene it is advantageous if the metering liquid receptacle and the pipette opening are formed on a pipette tip which is formed separately from the pipette duct comprising the throttle point and is selectively connectable to and/or separable from said pipette duct. By contrast, outlets (so-called "wash tubes") are preferably provided in manner fixed rigidly to the pipette device for the aforementioned wash-head pipette device.

The present invention will be described hereinafter in greater detail with reference to the accompanying drawing, which shows a highly schematic longitudinal section through an embodiment according to the invention of a pipette device.

BRIEF DESCRIPTION OF THE DRAWINGS

FIG. 1 is an embodiment according to the invention of a pipette device.

DETAILED DESCRIPTION

In FIG. 1 an embodiment according to the invention of a pipette device illustrated in a highly schematic manner is denoted generally by reference numeral 10. The pipette device 10 comprises a pipette duct 12, to which a pipette tip 14 is releasably coupled in a manner known per se.

The pipette duct 12 comprises a cylinder portion 16, in which a piston 18 is adjustable relative to the cylinder portion 16 along a longitudinal axis L of the pipette device 10 incident with the cylinder axis Z via a piston rod 20 and by a motor 22.

The motor 22 is controlled by a control unit 24, for example as a function of the detection signal of a pressure sensor 26 which detects the pressure of a working fluid, for example air, in a working chamber 28 of which the volume can be changed by the movement of the piston 18.

The pipette tip 14, which is releasable in a manner known per se from the pipette duct 12 by a discarding device 30 movable relative to the cylinder portion 16 along the longitudinal axis L of the pipette device 10, comprises a coupling region 32 which is designed for coupling to the pipette duct 12, a wall region 34 extending conically in the example shown in FIG. 1, and a pipette opening 36 through which a metering liquid can be aspirated into the metering liquid receptacle and dispensed therefrom as a function of the pressure of a working fluid with which a metering liquid receptacle 38, surrounded by a wall region 34 and optionally also by the coupling region 32, is filled, at least in part.

The module formed of the cylinder 16 and the piston 18 forms a pressure change device 40 for changing the pressure of working fluid in the metering liquid receptacle 38.

In accordance with the invention a throttle point 42 is provided between the pressure change device 40 and the metering liquid receptacle 38 and comprises a flow resistance $R_2$ for working fluid which is preferably calculated as follows:

$$R_2 = \frac{128 \cdot \eta_{Dst} \cdot l_{Dst}}{\pi \cdot d_{Dst}^4}$$

where $\eta_{Dst}$ is the dynamic viscosity of the working fluid, $l_{Dst}$ is a characteristic length of the throttle point 42 in the direction of flow of the working fluid during the dispensing of metering liquid, and where $d_{Dst}$ is a characteristic dimension of the cross-section of flow of the throttle point 42 and is the diameter of the throttle point 42 in the example shown in FIG. 1. In the example shown in FIG. 1, the throttle point 42 is basically formed by a cylindrical duct, in such a way that the length of the duct is the characteristic length $l_{Dst}$ of the throttle point 42.

The throttle point 42 may further comprises a valve 44, with which the throttle point 42 can be closed completely so as to interrupt a spread of the working fluid pressure from the working chamber 28 into the metering liquid receptacle 38.

The valve 44 is preferably likewise actuatable by the control means 24.

By contrast, the pipette opening 36 comprises a flow resistance $R_1$ during dispensing which is preferably given by $$R_1 = \frac{128 \cdot \eta_{Pof} \cdot l_{Pof}}{\pi \cdot d_{Pof}^4}$$

where $\eta_{Pof}$ is the dynamic viscosity of the medium flowing through the pipette opening 36, i.e. the metering liquid, $l_{Pof}$ is a characteristic length of an outlet end of the pipette tip 14 leading to the pipette opening 36, and $d_{Pof}$ is a characteristic dimension of the cross-section of flow of the pipette opening 36—in the present normal case of a circular pipette opening it is the diameter of the pipette opening 36.

In the example shown in FIG. 1 of a pipette tip 14 tapering conically or otherwise towards the pipette opening 36, the following approach for determining the characteristic length may be adopted:

The characteristic length l is that particular length of the discharge end of the pipette tip 14 starting from the pipette opening 36 to the point at which the cross-section of flow of the pipette tip 14 has double the area of the pipette opening 36. Since, in the case of a circular shape, the cross-section of flow is proportional to the square of the radius or the diameter, the length which exists between the respective tapering of cross-section of flow and a cross-section of flow of which the diameter is 42 times the diameter of the tapering of cross-section of flow can be assumed to be the characteristic length of a discharge region tapering conically or otherwise towards the respective tapering of cross-section of flow having the narrowest cross-section of flow.

More specifically, it has been found that with increasing cross-sections of flow in the pipette tip 14 or else in the throttle point 42, those regions of a considerably greater cross-section of flow than the narrowest cross-section of flow hardly contribute to the flow resistance of the respective discharge opening. In other words, those regions of the pipette tip 14 or of the throttle point 42 which have an area of cross-section of flow which is more than twice the size of the area of cross-section of flow of the narrowest cross-section contribute merely to an inferior extent to the respective flow resistance of the tapering of cross-section of flow in question. They can therefore be disregarded.

If the ratio of the two flow resistances at the throttle point 42 and the pipette opening 36, under consideration of the media flowing through the respective tapering of cross-section of flow in terms of the dynamic viscosity thereof, does not exceed a ratio of 0.5, preferably 0.3, most preferably 0.225, the dispensing behaviour of the pipette tip 14, which may also be rigidly connected to the pipette duct 12, is largely independent of changes to the cross-section of the flow, for example caused by deposits of dried and/or crystallised metering liquid.

The metering behaviour obviously changes with increasing tapering of the pipette opening 36 once the degree of tapering falls below a critical value, in spite of the provision of the throttle point 42, which is arranged fluid-mechanically between the pressure change device 40 and the metering liquid receptacle 38, in the pipette duct 12. However, the limit points at which the effects of such deposits at the pipette opening 36 or in an area in the vicinity of the pipette opening 36 become apparent during dispensing are delayed further in the direction of a cross-sectional tapering of the pipette opening 36.

The same applies to the aspiration of metering liquid.

If the ratio of cross-sections of the flow $R_2$ to $R_1$ is less than 0.001, preferably less than 0.00075 and most preferably less than 0.0005, the aspiration and dispensing behaviour of the pipette device may even be independent, within specific limits, of the viscosity of the metering liquid used, in such a way that metering liquids of different viscosity can be metered identically using the same pipette device 10 and the same operating parameters. This simplifies the operation of pipette devices considerably.

Tests have shown that metering liquids having a dynamic viscosity of up to 0.004 $Nsm^{-2}$, preferably 0.0035 $Nsm^{-2}$ and most preferably 0.0031 $Nsm^{-2}$ can be metered by a pipette device according to the invention without changing the operating parameters.

Metering tasks of pipette devices can thus be simplified considerably by the present invention.

The present invention is applicable, in particular, to metering tasks which are to be carried out by a pipette device 10 in the form of a "wash-head pipette device" when washing liquid is to be dispensed as a metering liquid in precise doses.

These wash-head pipette devices can be used to clean, in a defined manner, objects 37 in sample containers 39 or sample containers 39 themselves, which are generally arranged beneath the pipette opening 36, by dispensing a measured amount of washing liquid as metering liquid.

Such a wash-head pipette device 10 may thus comprise a metering liquid inlet 50 which, starting from a metering liquid reservoir 52, can discharge into the metering liquid receptacle 38 at a discharge opening 54.

In this case the metering liquid receptacle can advantageously be filled with metering liquid (in the form of washing liquid) via the metering liquid inlet 50, in such a way that, in this case, the metering liquid does not need to be aspirated through the pipette opening 36.

The metering liquid in the metering liquid reservoir 52 can be conveyed into the metering liquid receptacle 38 via the metering liquid inlet 50 by a pump 56 which can likewise be controlled by the control device 24. In order to adjust more precisely the flow rate conveyed through the metering liquid inlet 50, a valve 58 may also be provided at the metering liquid inlet 50, which valve can be opened and closed by the control device 24.

For example, a suitable programme in the control means can thus be used to establish a predetermined pressure in the metering liquid inlet 50, initially with a closed valve 58 owing to operation of the pump 56, whereupon the valve 58 is opened for a predetermined length of time and then closed again.

In order to prevent an undesired supply of residual metering liquid from the metering liquid inlet 50 into the metering liquid receptacle 38 or to minimise this, the valve 58 is preferably arranged at the discharge 54 or, in relation to the entire length of the metering liquid inlet, in the vicinity of the discharge 54. The distancing of the valve 58 from the discharge 54 should preferably not exceed 5% of the entire length of the metering liquid inlet 58.

The pipette device 50, in particular in the form of a wash-head pipette device 10, may comprise further pipette ducts in addition to the illustrated pipette duct 12 which are basically identical to the illustrated pipette duct 12, in such a way that the pipette duct 12 illustrated in FIG. 1 is described by way of example for all pipette ducts of a multi-duct pipette device. For example, wash-head pipette devices may comprise pipette ducts 12 in a matrix arrangement of 8×12=96 pipette ducts.

In a multi-duct pipette device, the metering liquid inlets 50 to each pipette duct 12 can be connected to a common metering liquid reservoir 52 via a common pump 56.

All piston rods 20 of the individual pipette ducts 12 can also be adjusted by a common motor 22.

Nevertheless, it is not to be ruled out that each pipette duct comprises its own motor 22, its own pump 56 and/or its own metering liquid reservoir 52.

The fixing means 60 is intended to show that the pipette tip 34, in the form of a wash tube, can be coupled lastingly and unreleasably to the pipette duct 12. The wash tube can also be formed in one piece with a tube of the pipette duct, for example with the cylinder portion 16.

The invention claimed is:

1. A pipette device, at least for dispensing metering liquid by increasing the pressure of a working fluid, the pipette device comprising:

a metering liquid receptacle designed to be filled, at least in part, with working fluid and having a pipette opening as a first tapering of cross-section of flow, through which metering liquid can be dispensed from the metering liquid receptacle as a function of the pressure of the working fluid;

a pressure change device which is designed to change the pressure of the working fluid in the metering liquid receptacle; and a throttle point in a pipette duct designed to be filled with working fluid as a further tapering of cross-section of flow;

wherein said throttle point is arranged fluid-mechanically between the metering liquid receptacle and the pressure change device and is dimensioned in such a way that a ratio of a flow resistance of the pipette opening for dispensed metering liquid to a flow resistance of the throttle point for working fluid, which flows through the throttle point when the metering fluid is dispensed, is less than 0.5; and wherein the flow resistances of the respective tapering of cross-section of flow is calculated under consideration of the product of the viscosity of the medium of working fluid and metering liquid associated with the respective tapering of cross-section of flow and the characteristic length of the associated tapering of cross-section of flow, divided by the fourth power of the characteristic dimension of the cross-section of flow of the associated tapering of cross-section of flow.

2. A pipette device according to claim 1, wherein the pipette device is a wash-head pipette device designed to dispense washing liquid as metering liquid and comprises a metering liquid inlet configured to discharge into the metering liquid receptacle in such a way that the metering liquid receptacle can be filled, at least in part, with metering liquid via the metering liquid inlet.

3. A pipette device according to claim 1, wherein the pipette device is designed to aspirate metering liquid by reducing the pressure of the working fluid, wherein the pipette device is designed such that the metering liquid can be aspirated into the metering liquid receptacle through the pipette opening as a function of the pressure of the working fluid, and wherein the ratio of the flow resistance of the pipette opening for dispensed metering liquid to the flow resistance of the throttle point is less than 0.001, in the case of working fluid flowing therethrough during dispensing of the metering fluid.

4. A pipette device according to claim 1, wherein the viscosity of the metering liquid does not exceed the value of 0.004 $Nsm^{-2}$.

5. A pipette device according to claim 1, wherein the viscosity of the working fluid does not exceed the value of 0.00003 $Nsm^{-2}$.

6. A pipette device according to claim 1, wherein the throttle point has a cross-section of flow which can be changed selectively.

7. A pipette device according to claim 1, wherein the pipette duct comprises a valve that is adjustable between a closed position, in which a working fluid flow in the pipette duct is prevented, and an open position, in which a working fluid flow in the pipette duct is enabled.

8. A pipette device according to claim 7, wherein the valve is provided at the throttle point or fluid-mechanically between the pressure change device and the throttle point.

9. A pipette device according to claim 1, further comprising:

at least one reservoir of working fluid subjected to a system pressure as the pressure change device.

10. A pipette device according to claim 9, further comprising;

a dispensing reservoir subjected to a first system pressure; and an aspiration reservoir subjected to a second system pressure, wherein the dispensing reservoir and the aspiration reservoir are selectively connectable to the pipette duct in a pressure-transmitting manner and are separable therefrom, wherein the first system pressure is greater than an ambient pressure of the pipette device and the second system pressure is lower than the ambient pressure.

11. A pipette device according to claim 9, wherein the system pressure for dispensing processes does not exceed an overpressure of 1.5 bar compared to the ambient pressure of the metering liquid receptacle.

12. A pipette device according to claim 1, wherein the pressure change device comprises a pump that is driven by a motor.

13. A pipette device according to claim 1, wherein the pressure change device comprises a piston-cylinder device having a cylinder extending along a cylinder axis and having a piston received movably therein along the cylinder axis, and wherein the cylinder and piston define at least one working volume that can be changed by a relative movement of the piston relative to the cylinder and is in fluid communication with the pipette duct or can be brought into fluid communication therewith.

14. A pipette device according to claim 1, wherein the metering liquid receptacle and the pipette opening are provided on a pipette tip that is formed separately from the pipette duct comprising the throttle point, and wherein said pipette tip is selectively connectable to and/or separable from said pipette duct.

15. A pipette according to claim 1, wherein said throttle point is dimensioned in such a way that a ratio of a flow resistance of the pipette opening for dispensed metering liquid to a flow resistance of the throttle point for working fluid, which flows through the throttle point when the metering fluid is dispensed, is less than 0.3.

16. A pipette according to claim 1, wherein said throttle point is dimensioned in such a way that a ratio of a flow resistance of the pipette opening for dispensed metering liquid to a flow resistance of the throttle point for working fluid, which flows through the throttle point when the metering fluid is dispensed, is less than 0.225.

* * * * *